US007256740B2

(12) United States Patent
Tinsley et al.

(10) Patent No.: US 7,256,740 B2
(45) Date of Patent: Aug. 14, 2007

(54) ANTENNA SYSTEM USING COMPLEMENTARY METAL OXIDE SEMICONDUCTOR TECHNIQUES

(75) Inventors: Keith R. Tinsley, Beaverton, OR (US); Seong-Youp Suh, San Jose, CA (US)

(73) Assignee: Intel Corporation, Santa Clara, CA (US)

( * ) Notice: Subject to any disclaimer, the term of this patent is extended or adjusted under 35 U.S.C. 154(b) by 202 days.

(21) Appl. No.: 11/095,326

(22) Filed: Mar. 30, 2005

(65) Prior Publication Data

US 2006/0220961 A1 Oct. 5, 2006

(51) Int. Cl.
*H01Q 1/38* (2006.01)

(52) U.S. Cl. ..... 343/700 MS; 343/856; 343/893

(58) Field of Classification Search ..... 343/700 MS, 343/793, 850, 856, 893; 342/372
See application file for complete search history.

(56) References Cited

U.S. PATENT DOCUMENTS 6,781,424 B2 8/2004 Lee et al. ..... 327/113
2004/0095277 A1 5/2004 Mohamadi ..... 343/700 MS
2004/0095287 A1 5/2004 Mohamadi ..... 343/824
2004/0263393 A1 12/2004 Lynch et al. ..... 343/700 MS

FOREIGN PATENT DOCUMENTS

WO 0016492 A1 3/2000

OTHER PUBLICATIONS

PCT International Search Report, International Application No. PCT/US2006/012388, Date of Mailing of the International Search Report: Aug. 18, 2006, pp. 1-4.

*Primary Examiner*—Hoang Nguyen
*Assistant Examiner*—Ephrem Alemu
(74) *Attorney, Agent, or Firm*—Kacvinsky LLC

(57) ABSTRACT

Apparatus, system, and method are described for a complementary metal oxide semiconductor (CMOS) integrated circuit device having a first metal layer that includes a radiating element and a second metal layer that includes a first conductor coupled to the radiating element. The first conductor and the radiating element are mutually coupled to form an antenna to wirelessly communicate a signal.

26 Claims, 7 Drawing Sheets

ANTENNA SYSTEM USING COMPLEMENTARY METAL OXIDE SEMICONDUCTOR TECHNIQUES

BACKGROUND

Every wireless communication device includes an antenna in some form or configuration. An antenna is designed to launch an electromagnetic signal with certain desired characteristics including, for example, direction of radiation, coverage area, emission strength, beam-width, and sidelobes, among other characteristics. Antennas are available in many types. Each type generally includes a conductive metallic structure such as wire or metal surface to radiate and receive electromagnetic energy. Common types of antennas include dipole, loop, array, patch, pyramidal horn connected to a waveguide, millimeter-wave microstrip, coplanar waveguide, slotline, and printed circuit antennas.

Antennas may be integrally formed in microwave integrated circuits (MIC) or monolithic microwave integrated circuits (MMIC). These types of integrated antennas use transmission lines and waveguides as the basic building blocks. Conventional integrated antennas are formed on single layer substrates either on ceramics and laminates or Gallium Arsenide (GaAs) monolithic integrated circuit implementations. The transmission lines used in these applications utilize microstrip or coplanar waveguides (CPW) for their ease of fabrication and integration with active and discrete components.

Millimeter-wave microstrip antenna technology may be designed for a range of applications in the microwave electromagnetic spectrum. Millimeter-wave microstrip antennas are designed to operate in the electromagnetic spectrum ranging from 30 GHz to 300 GHz, corresponding to wavelengths ranging from 10 mm to 1 mm. Applications for these antennas include personal area networking (PAN), broadband wireless networking, wireless portable devices, wireless computers, servers, workstations, laptops, ultra-laptops, handheld computers, telephones, cellular telephones, pagers, walkie-talkies, routers, switches, bridges, hubs, gateways, wireless access points (WAP), personal digital assistants (PDA), televisions, motion picture experts group audio layer 3 devices (MP3 player), global positioning system (GPS) devices, electronic wallets, optical character recognition (OCR) scanners, medical devices, cameras, and so forth.

DETAILED DESCRIPTION

Figure 1:
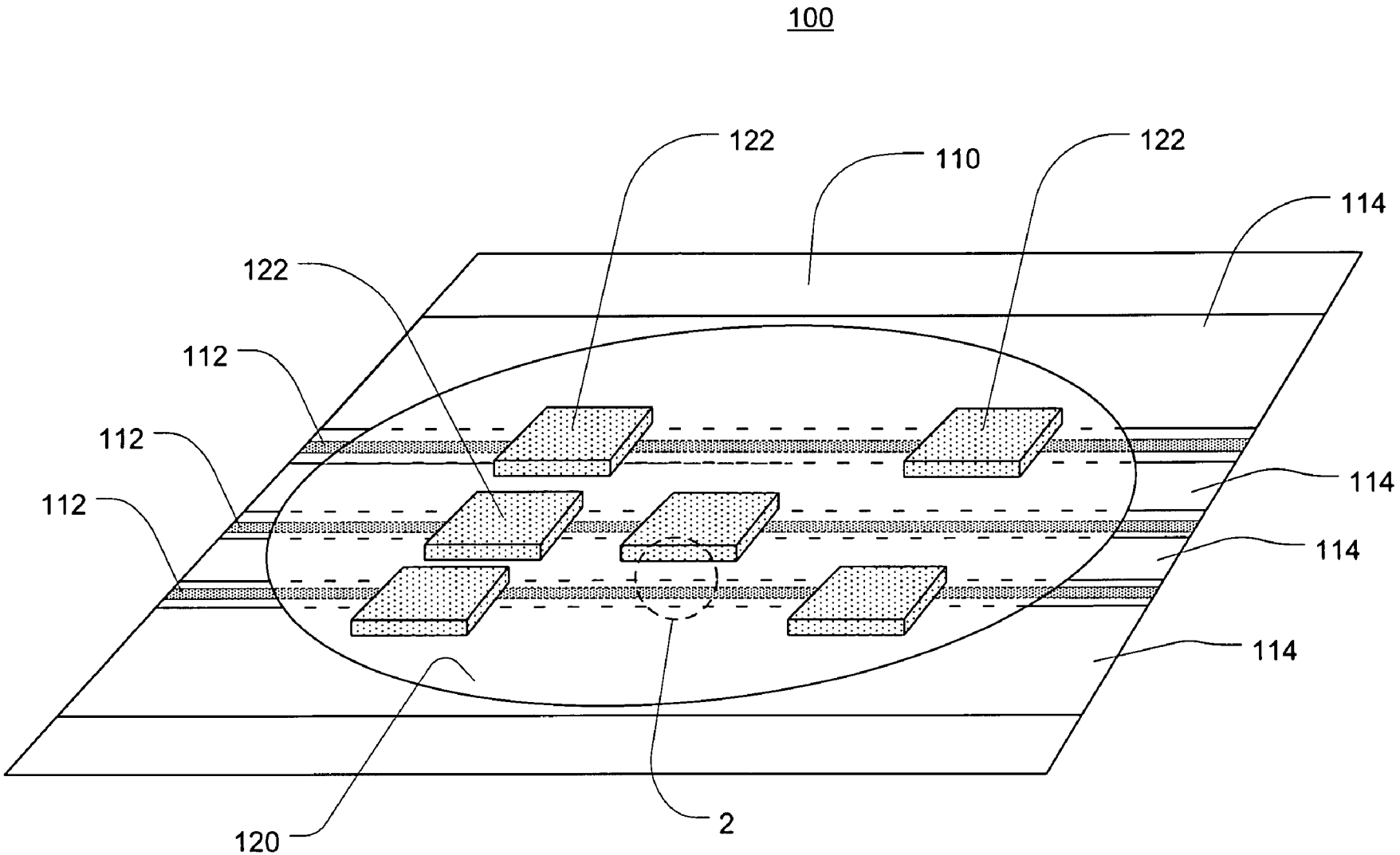
FIG. 1 illustrates one embodiment of an antenna system 100.

FIG. 1 illustrates one embodiment of an antenna system 100. In one embodiment, the antenna system 100 may be implemented as a multiple N-element millimeter-wave (mmWave) passive antenna system, for example. In one embodiment, the antenna system 100 may be implemented in a standard complementary metal oxide semiconductor (CMOS) fabrication and metallization process. In one embodiment, the system 100 provides a mmWave integrated circuit (IC) communication system utilizing characteristics of fabrication techniques associated with a very large scale integration (VLSI) CMOS process used to form metal oxide semiconductor field effect transistor (MOSFET) devices, for example. In one embodiment, the antenna system 100 may be formed one or more metallization layers such as a metal layer 110 and a metal layer 120, among others, for example. Electromagnetic radio frequency (RF) conductors forming transmission lines 112 corresponding to mmWave frequencies (wavelengths) may be formed on the metal layer 110. Associated ground planes 114 for signal/mode field line terminations also may be formed on the metal layer 110 or on one or more other metal layers below the metal layer 110 depending on the particular implementation of the antenna system 100. Some implementations may not require the use of the ground planes 114, such as for example, some implementations utilizing a slotline transmission line. The transmission lines 112 may be arranged to form microstrip, stripline, coplanar waveguides, and/or slotline transmission lines and/or feed lines, among others, for example. In one embodiment, the antenna system 100 may comprise the radiating elements 122 formed on the metal layer 120, for example. In one embodiment, the metal layer 120 may be a top metal layer located above the metal layer 110 and the transmission lines 112, for example. In one embodiment, the radiating elements 122 may be formed as raised metal "dummy fills" in a standard CMOS fabrication process, for example. The radiating elements 122 may be formed as an array to realize a mmWave antenna system. As shown in more detail in enlarged view 2 (FIG. 2), the radiating elements 122 may be coupled to the transmission lines 112 through mutual inductance coupling, electric field coupling, or magnetic field coupling. The RF energy may be coupled between the radiating elements 122 and the transmission lines 112 via transverse electromagnetic (TEM) modes created by stimulating the transmission lines 112 (e.g., coplanar waveguide strips) located on the metal layer 110, which in one embodiment, may be located one metal layer below the metal layer 120, for example. In one embodiment, the metal layer 110 may be located approximately 10 μm below the metal layer 120, for example. In one embodiment, the radiating elements 122 may be formed with dimensions commensurate with the conductivities of the metal layers 110, 120, material loss tangents, and substrate dielectrics to yield a directive antenna system for signal transmission at mmWave frequencies (wavelengths).

Conventional implementations of on die mmWave antenna systems are generally formed in GaAs, Indium Phosphide (InP) or other high electron mobility materials. The antenna system 100 may be implemented on a die. Further, in one embodiment, the antenna system 100 may be implemented on a die as a mmWave antenna system comprising materials associated with CMOS devices and using CMOS processing techniques. In one embodiment, the antenna system 100 may be formed in large scale/low cost integration processing for wireless communications applications. In one embodiment, the antenna system 100 may be realized in a 130 nm CMOS process to yield devices for amplifying mmWave signals. Other embodiments of the system 100 may be realized in 90 nm and 65 nm processes, among others, for example. In one embodiment, the antenna system 100 may be realized as an on-die directive mmWave antenna system. Embodiments of the antenna system 100 may provide, for example, "on-die" high gain/directive antennas for mmWave wavelengths wireless communications rather than external (off-die/off-package) antenna system for directing mmWave signals as some conventional antenna systems, for example.

Embodiments of the antenna system 100 also may be formed as a part of an interconnect system for ICs. For example, embodiments of the antenna system 100 may be formed as part of any wireless or flipchip interconnect device or scheme that may be used in mmWave wireless communication systems, for example. In one embodiment, the antenna system 100 may be realized as die-package-antenna-air wireless interface at mmWave frequencies for CMOS devices, among others, for example. In one embodiment, the antenna system 100 may be realized as die-antenna-air wireless interfaces at mmWave frequencies for CMOS devices, among others, for example. Various embodiments of the antenna system 100 may be form or implemented as part of a personal area networking device comprising mmWave CMOS circuitry and the system 100 may be integrated into consumer electronics (CE) peripherals for coordination with future personal area networking implementations.

Figure 2:
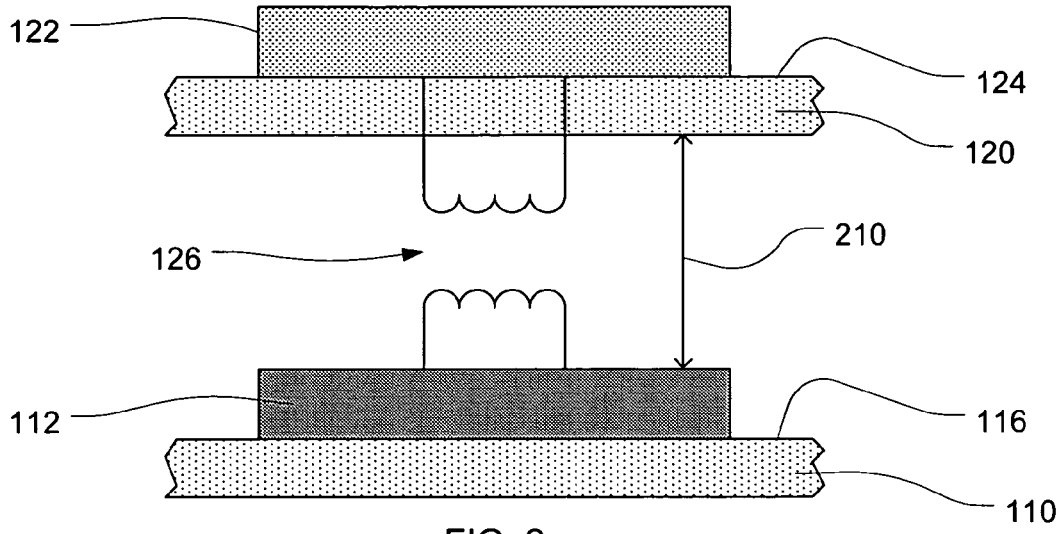
FIG. 2 illustrates one embodiment of an enlarged view of layers of system 100.

FIG. 2 illustrates one embodiment of an enlarged view of layers of system 100. In one embodiment, FIG. 2 illustrates the layers between the metal layer 110 and the metal layer 120. The radiating element 122 is formed on side 124 of the metal layer 120. The transmission line 112 is formed on side 116 of the metal layer 110. The distance 210 between the metal layer 110 and the metal layer 120 may be approximately 10 μm, although embodiments are not limited in this context. Mutual inductance 126 provides the coupling between the radiating element 122 formed on the side 124 of the metal layer 120 and the transmission line 112 formed on the side 116 of the metal layer 110.

Figure 3:
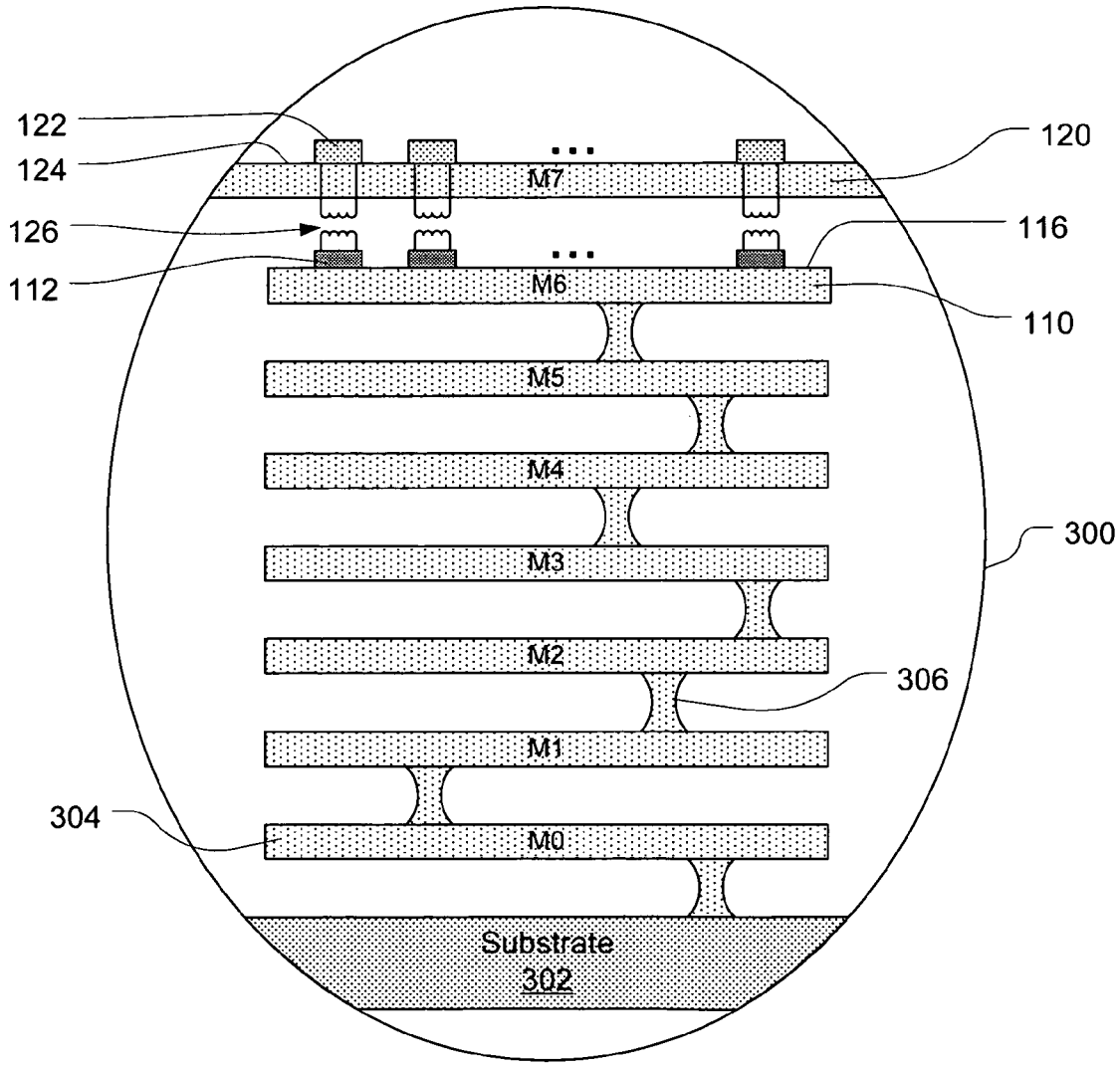
FIG. 3 illustrates one embodiment of a vertical slice of a CMOS semiconductor.

FIG. 3 is an illustration of one embodiment of a vertical slice 300 of a CMOS semiconductor formed on substrate 302. FIG. 3 illustrates an eight metal layer device (M0-M7), for example. Nevertheless, embodiments may be formed on CMOS semiconductors comprising $M_N$ metallization layers. In one embodiment, the metal layer M0 304 is a short name for the first metal layer called "Metal 1" and so forth up to the top metal layer M7, the eighth metal layer 120, for example. One or more radiating elements 122 may be formed on the side 124 of the metal layer 120. The metal layer 110 (M6) is the metal layer just below the top metal layer 120. The transmission lines 112 may be formed on side 116 of the metal layer 110. The metal layers M0-M6 may be interconnected through vias 306. The transmission lines 112 and the radiating elements 122 may be connected or coupled through the mutual inductance 126 therebetween, for example.

Figure 4B:
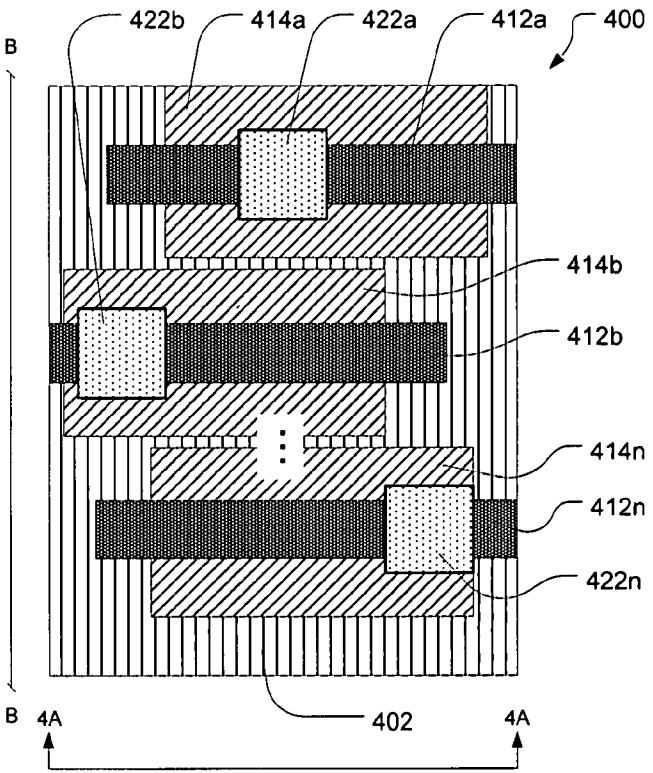
FIGS. 4A-4C illustrate a cross sectional side view, top view, and front view of one embodiment of a microstrip antenna system 400.
Figure 4C:
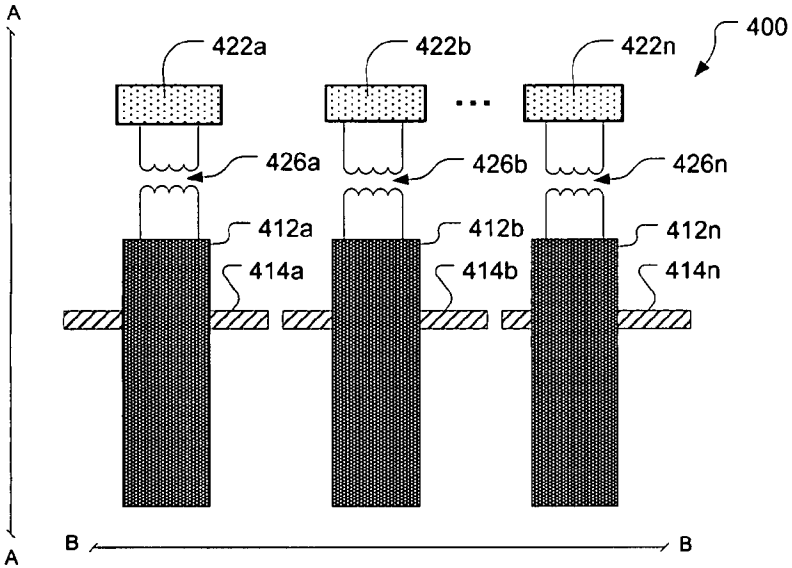
Figure 4A:
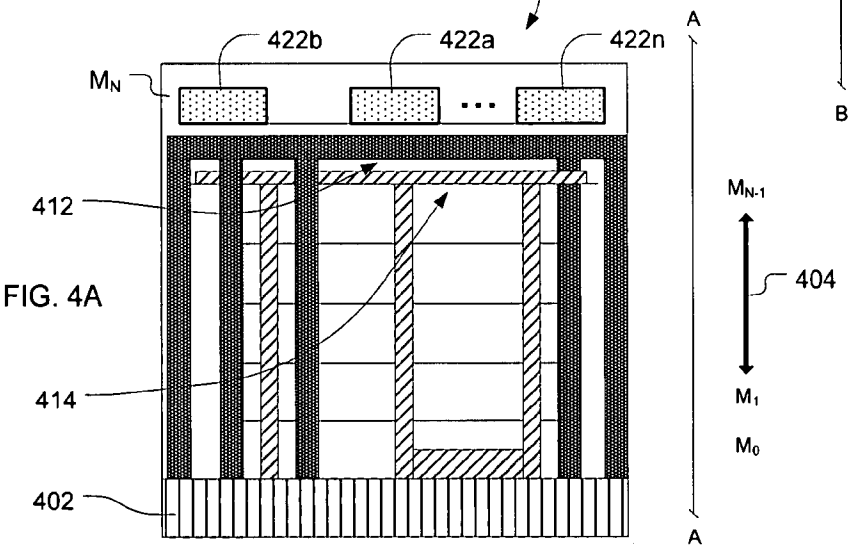

FIGS. 4A-4C illustrate a cross sectional side view, top view, and front view of one embodiment of a microstrip (e.g., stripline) antenna system 400 formed using a CMOS fabrication and metallization process. In one embodiment, one or more radiating elements 422*a, b, n* may be formed as an array of raised metal "dummy fills" in a standard CMOS fabrication process. The microstrip antenna system 400 may be implemented in mmWave antenna system in microwave ICs, electronic components, and/or interconnect devices, among others, for example. Active elements, including the radiating elements 422*a, b, n* may be formed on a top metal layer $M_N$ in accordance with standard CMOS processing techniques, for example. Other elements such as ground planes 414*a, b, n* and transmission lines 412*a, b, n* may be formed on one or more sub-metal layers 404 $M_1$-$M_{N-1}$ located below the top metal layer $M_N$, for example. The embodiments, however, are not limited in this context.

FIG. 4A is a cross-sectional side view of the microstrip antenna system 400 comprising one or more conductive strips (e.g., striplines) forming one or more microstrip transmission lines 412 and one or more ground planes 414, for example. The transmission lines 412 and the ground planes 414 may be formed on separate sub-metal layers 404 (M1-$M_{N-1}$) in a CMOS semiconductor formed on substrate 402. In one embodiment, the microstrip transmission lines 412 may be located on any one of the metal layers 404 above the ground planes 414 and below the top metal layer $M_N$. The microstrip transmission lines 412 may be located on separate metal layers than the top metal layer $M_N$ of the CMOS semiconductor on which the radiating elements 422*a, b, n* are formed. Accordingly, in one embodiment, the microstrip transmission lines 412 may be sandwiched between the ground planes 414 and the radiating elements 422*a, b, n*, for example. In one embodiment, the microstrip transmission lines 412, the ground planes 414, and the radiating elements 422*a, b, n*, may be formed with geometries (e.g., dimensions) that are consistent with wavelengths (or frequencies) associated with stripline mmWave applications, for example.

FIG. 4B is a top view of the microstrip antenna system 400 showing the relationship between the radiating elements 422*a, b, n*, the microstrip transmission lines 412*a, b, n*, and the ground planes 414*a, b, n*, of the CMOS semiconductor formed on the substrate 402. The microstrip transmission lines 412*a, b, n* may be formed as conductive strips on a metal layer $M_{N-1}$ located above the ground planes 414*a, b, n* and located below the top metal layer $M_N$ on which the radiating elements 422*a, b, n* may be formed on the CMOS semiconductor, for example. As shown in FIG. 4B, the radiating elements 422*a, b, n*, the microstrip transmission lines 412*a, b, n*, and the ground planes 414*a, b, n* are in a substantially overlapped with respect relative to each other.

FIG. 4C is a front view of the microstrip antenna system 400 showing the relationship between the radiating elements 422*a, b, n*, the microstrip transmission lines 412*a, b, n*, and the ground planes 414*a, b, n* formed on sub-metal layers 404 ($M_1$-$M_N$) of the CMOS semiconductor. In one embodiment, the microstrip transmission lines 412*a, b, n* and the ground planes 414*a, b, n* may be formed on sub-metal layers 404 (FIG. 4A, $M_1$-$M_{N-1}$) below the top metal layer $M_N$. In one embodiment, the microstrip transmission lines 412*a, b, n* may be formed as conductive metal strips above the ground planes 414*a, b, n* and at least one metal layer below the top metal layer $M_N$ (FIG. 4A).

In one embodiment, the microstrip transmission lines 412*a, b, n* may be coupled to the radiating elements 422*a, b, n* through mutual inductances 426*a, b, n*, respectively. In one embodiment, the radiating elements 422*a, b, n* located on metal layer $M_N$ may be coupled to the microstrip transmission lines 412*a, b, n*, respectively, located on metal layer $M_{N-1}$ via mutual inductance coupling, electric field coupling, or magnetic field coupling, represented generally as mutual inductance 426*a, b, n*, respectively, for example. In one embodiment, RF energy may be coupled between the radiating elements 422*a, b, n* and the microstrip transmission lines 412*a, b, n* via transverse electromagnetic (TEM) modes created by electrically stimulating the microstrip transmission lines 412*a, b, n*, for example. In one embodiment, the metal layer $M_{N-1}$ may be located approximately 10 μm below the metal layer $M_N$, for example. In one embodiment, the radiating elements 422*a, b, n* may be formed with dimensions commensurate with the conductivities of the metal layers 404 including $M_N$ (FIG. 4A), material loss tangents, and substrate dielectrics to yield a directive antenna system for signal transmission and reception at mmWave frequencies (wavelengths). The embodiments, however, are not limited in this context.

Figure 5B:
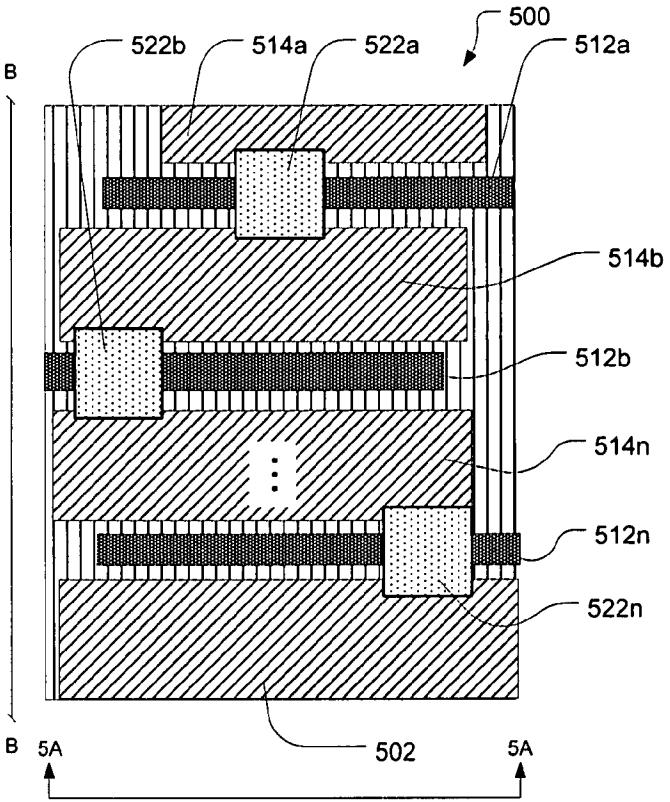
FIGS. 5A-5C illustrate a cross sectional side view, top view, and front view of one embodiment of a coplanar waveguide antenna system 500.
Figure 5C:
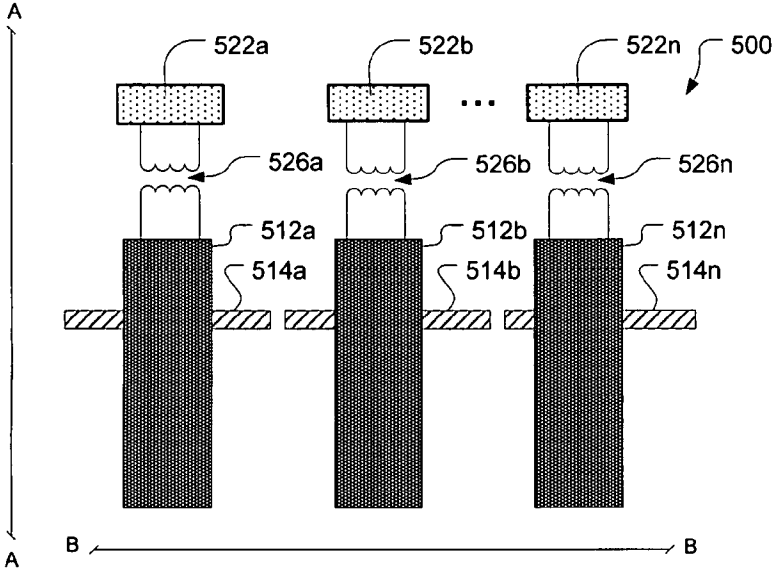
Figure 5A:
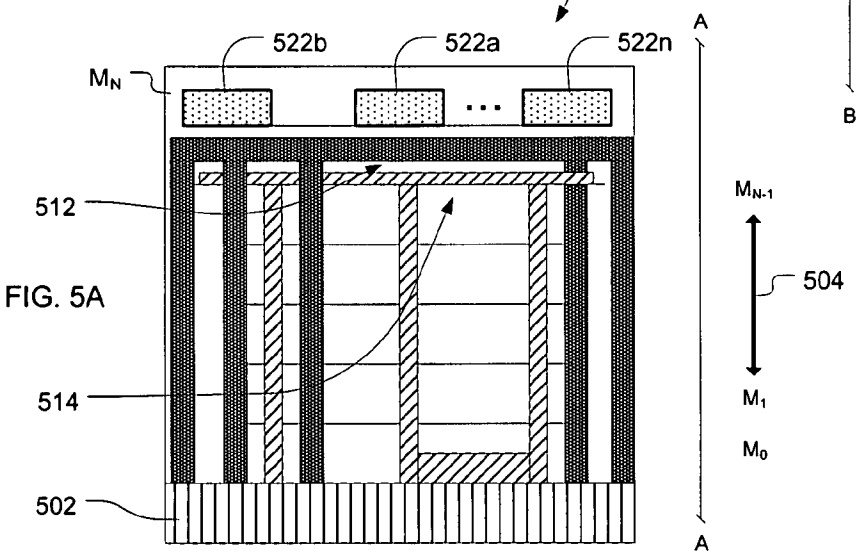

FIGS. 5A-5C illustrate a cross sectional side view, top view, and front view of one embodiment of a coplanar waveguide antenna system 500 formed using a CMOS fabrication and metallization process. In one embodiment, one or more radiating elements 522*a, b, n* also may be formed as an array of raised metal "dummy fills" in a standard CMOS fabrication process. The coplanar waveguide antenna system 500 may be implemented in mmWave antenna system in microwave ICs, electronic components, and/or interconnect devices, among others, for example. All active elements, including the radiating elements 522*a, b, n* may be formed on a top metal layer $M_N$ in accordance with standard CMOS processing techniques. Other elements such as ground planes 514*a, b, n* and transmission lines 512*a, b, n* may be formed on sub-metal layers 504 $M_1$-$M_{N-1}$ located below the top metal layer $M_N$, for example. The embodiments, however, are not limited in this context.

FIG. 5A is a cross-sectional side view of the coplanar waveguide antenna system 500 comprising one or more conductors forming coplanar waveguide transmission lines 512 laterally separated in a non-overlapping relationship from one or more ground planes 514. In one embodiment, the coplanar waveguide transmission lines 512 and the ground planes 514 may be coplanar, e.g., located on the same plane. In one embodiment, the coplanar waveguide transmission lines 512 and the ground planes 514 may be formed on separate sub-metal layer 504 (M1-$M_{N-1}$) planes of a CMOS semiconductor formed on a substrate 502, but still laterally separated such that the coplanar waveguide transmission lines 512 and the ground planes 514 do not overlap. In one embodiment, the coplanar waveguide transmission lines 512 may be located either on the metal layers above the ground planes 514 or may be located on the same metal layers as the ground planes 514. For example, in one embodiment, the coplanar waveguide transmission lines 512 and ground planes 514 are laterally separated and the radiating elements 522*a, b, n* are located above the coplanar waveguide transmission lines 512 on the top metal layer $M_N$ of the CMOS semiconductor. Whether a particular implementation provides the coplanar waveguide transmission lines 512 and the ground planes 514 on the same metal layer plane or on separate metal layer planes, the coplanar waveguide transmission lines 512 are located between the ground planes 514 and one or more metal layers below the radiating elements 522*a, b, n*, for example. In one embodiment, the coplanar waveguide transmission lines 512, the ground planes 514, and the radiating elements 522*a, b, n*, may be formed with geometries (e.g., dimensions) that are consistent with wavelengths (or frequencies) associated with stripline mmWave applications, for example.

FIG. 5B is a top view of the coplanar waveguide antenna system 500 showing relationship between the radiating elements 522*a, b, n*, the coplanar waveguide transmission lines 512*a, b, n*, and the ground planes 514*a, b, n*. The coplanar waveguide transmission lines 512*a, b, n* may be formed as conductive strips on the metal layer $M_{N-1}$, which may be located above or on the same metal layer plane as the ground planes 514*a, b, n*. The coplanar waveguide transmission lines 512*a, b, n* are located below the radiating elements 522*a, b, n* formed on the top metal layer $M_N$ of the CMOS semiconductor. For example, the coplanar waveguide transmission lines 512*a, b, n* may be formed on metal layer $M_{N-1}$. The coplanar waveguide transmission lines 512*a, b, n*, are laterally separated from the ground planes 514*a, b, n* in a non-overlapping relationship. The radiating elements 522*a, b, n* are located above the coplanar waveguide transmission lines 512*a, b, n* in a substantially overlapping relationship, for example.

FIG. 5C is a front view of the coplanar waveguide antenna system 500 showing the relationship between the radiating elements 522*a, b, n*, the coplanar waveguide transmission lines 512*a, b, n* and the ground planes 514*a, b, n* are formed on the sub-metal layers 504 (FIG. 5A, $M_1$-$M_{N-1}$) below the top metal layer $M_N$ of the CMOS semiconductor. In one embodiment, the coplanar waveguide transmission lines 512*a, b, n* may be formed as conductive metal strips above and between the ground planes 514*a, b, n* and at least one metal layer below the radiating elements 522*a, b, n* formed on the top metal layer $M_N$ (FIG. 5A).

In one embodiment, the coplanar waveguide transmission lines 512*a, b, n* may be coupled to the radiating elements 522*a, b, n* through mutual inductances 526*a, b, n*, respectively. In one embodiment, the radiating elements 522*a, b, n* located on metal layer $M_N$ may be coupled to the coplanar waveguide transmission lines 512*a, b, n*, respectively, located on metal layer $M_{N-1}$ via mutual inductance coupling, electric field coupling, or magnetic field coupling, represented generally as mutual inductances 526*a, b, n*, respectively. In one embodiment, RF energy may be coupled between the radiating elements 522*a, b, n* and the coplanar waveguide transmission lines 512*a, b, n* via TEM modes created by electrically stimulating the coplanar waveguide transmission lines 512*a, b, n*, for example. In one embodiment, the metal layer $M_{N-1}$ may be located approximately 10 μm below metal layer $M_N$, for example. In one embodiment, the radiating elements 522*a, b, n* may be formed with dimensions commensurate with the conductivities of the metal layers 504 including $M_N$ (FIG. 5A), material loss tangents, and substrate dielectrics to yield a directive antenna system for signal transmission and reception at mmWave frequencies (wavelengths). The embodiments, however, are not limited in this context.

Figure 6B:
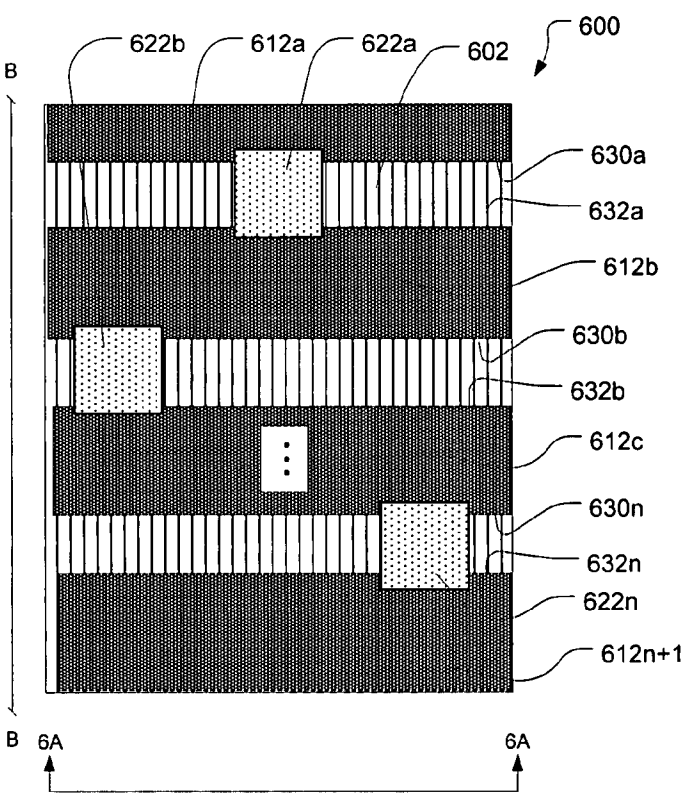
FIGS. 6A-6C illustrate a cross sectional side view, top view, and front view of one embodiment of a slotline antenna system 600.
Figure 6C:
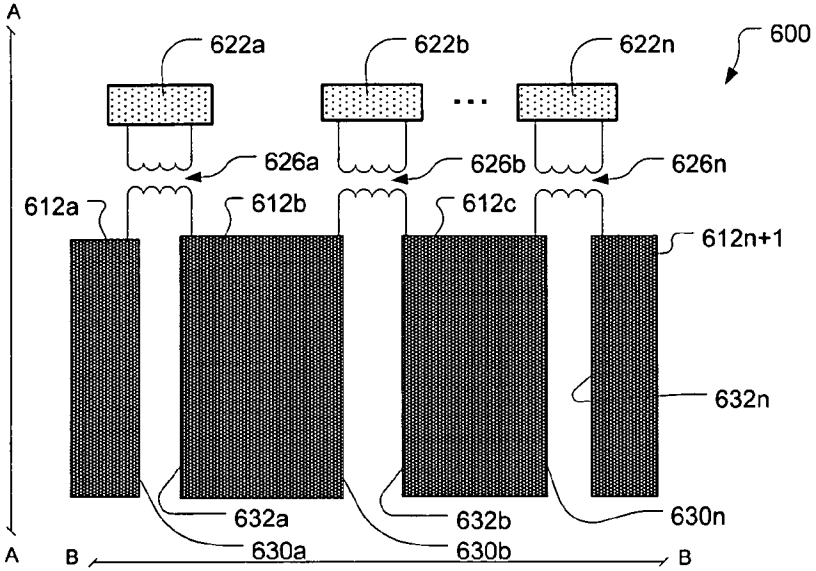
Figure 6A:
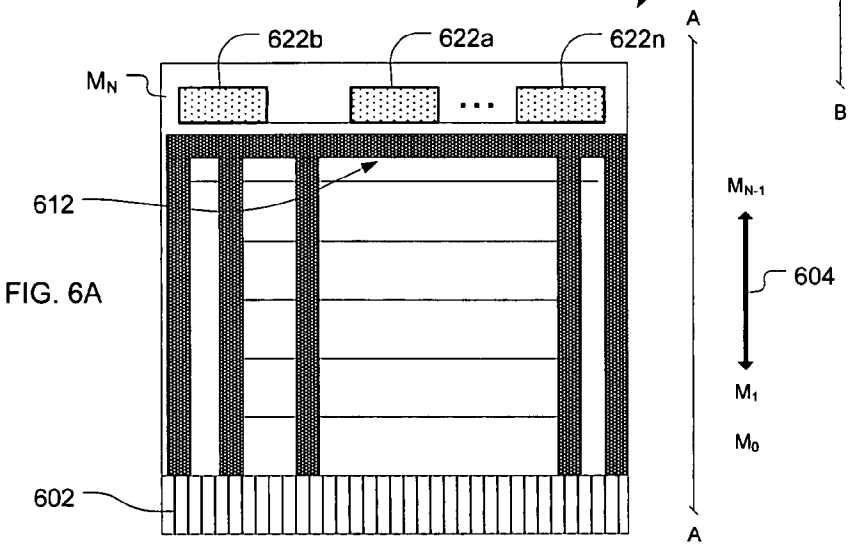

FIGS. 6A-6C illustrate a cross sectional side view, top view, and front view of one embodiment of a slotline antenna system 600 formed using a CMOS fabrication and metallization process. In one embodiment, radiating elements may be formed as an array of raised metal "dummy fills" in a standard CMOS fabrication process. The slotline system 600 may be implemented in mmWave antenna system in microwave ICs, electronic components, and/or interconnect devices, among others, for example. All active elements, including the radiating elements 622*a, b, n* may be formed on a top metal layer $M_N$ in accordance with standard CMOS processing techniques. Other elements such as transmission lines 612*a, b, c, n*+1 may be formed on sub-metal layers 604 $M_1$-$M_{N-1}$ below the top metal layer $M_N$, for example. The embodiments, however, are not limited in this context.

FIG. 6A is a cross-sectional side view of the slotline antenna system 600 comprising one or more conductors forming slotline transmission lines 612. In one embodiment, the slotline transmission lines 612 may be located on the same metal layer plane, for example. In one embodiment, the slotline transmission lines 612 may be formed on sub-metal layers 604 (M1-$M_{N-1}$) of a CMOS semiconductor formed on a substrate 602. In one embodiment, the slotline transmission lines 612 may be separated from the radiating elements 622*a, b, n* located on the top metal layer $M_N$ of the CMOS semiconductor. In one embodiment, the slotline transmission lines 612 are located below the radiating elements 622*a, b, n*, for example. In one embodiment, the slotline transmission lines 612 and the radiating elements 622*a, b, n*, may be formed with geometries (e.g., dimensions) that are consistent with wavelengths (or frequencies) associated with slotline mmWave applications, for example.

FIG. 6B is a top view of the slotline antenna system 600 showing the relationship between the radiating elements 622*a, b, n* and the slotline transmission lines 612*a, b, c, n*+1. The slotline transmission lines 622*a, b, n* may be formed as conductive strips on the sub-metal layers 604 ($M_1$-$M_{N-1}$) (FIG. 6A) of the CMOS semiconductor formed on the substrate 602. In one embodiment, the slotline transmission lines 612*a, b, c, n*+1 may be formed as conductive strips on the metal layer $M_{N-1}$ just below the top metal layer $M_N$. The slotline transmission lines 612*a, b, c, n*+1 may be located below the radiating elements 622*a, b, n* formed on the top metal layer $M_N$ of the CMOS semiconductor. For example, the slotline transmission lines 612*a, b, c, n*+1 may be formed on the metal layer $M_{N-1}$ such that the radiating elements 622*a, b, n* overlap with the edges 630*a, b, n* and 632*a, b, n* of the slotline transmission lines 612*a, b, c, n*+1, respectively.

FIG. 6C is a front view of the slotline antenna system 600 showing the relationship between the radiating elements 622*a, b, n* and the slotline transmission lines 612*a, b, c, n*+1 formed on the one embodiment of the slotline transmission lines 612*a, b, n* formed on the sub-metal layers 604 (FIG. 6A, $M_1$-$M_{N-1}$) below the top metal layer $M_N$. In one embodiment, the slotline transmission lines 612*a, b, c, n*+1 may be formed as conductive metal strips with edges 630*a, b, n* and 632*a, b, n* that are overlapped by the radiating elements 622*a, b, n* formed on the top metal layer $M_N$ (FIG. 6A).

In one embodiment, the slotline transmission lines 612*a, b, c, n*+1 may be coupled to the radiating elements 622*a, b, n* through mutual inductances 626*a, b, n*, respectively. In one embodiment, the radiating elements 622*a, b, n* located on the metal layer $M_N$ may be coupled to the slotline transmission lines 612*a, b, c, n*+1, respectively, located on the metal layer $M_{N-1}$ via mutual inductance coupling, electric field coupling, or magnetic field coupling, represented generally as mutual inductances 626*a, b, n*, respectively. In one embodiment, RF energy may be coupled between the radiating elements 622*a, b, n* and the slotline transmission lines 612*a, b, c, n*+1 via TEM modes created by electrically stimulating the slotline transmission lines 612*a, b, c, n*+1, for example. In one embodiment, the metal layer $M_{N-1}$ may be located approximately 10 μm below the metal layer $M_N$, for example. In one embodiment, the radiating elements 622*a, b, n* may be designed to dimensions commensurate with conductivities of the metal layers 604 including $M_N$ (FIG. 6A), material loss tangents, and substrate dielectrics to yield a directive antenna system for signal transmission and reception at mmWave frequencies (wavelengths). The embodiments, however, are not limited in this context.

Figure 7:
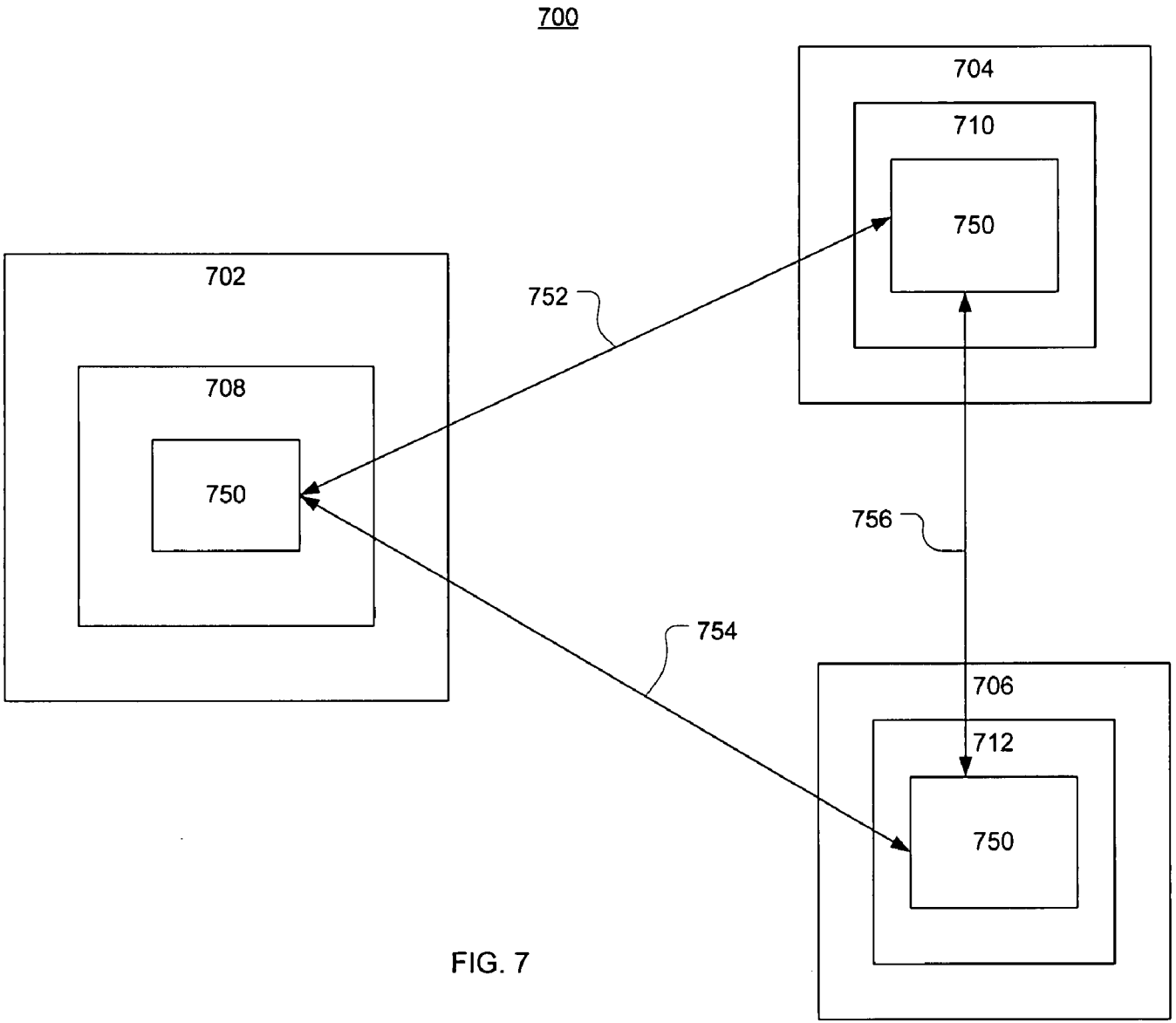
FIG. 7 illustrates one embodiment of a block diagram of a system 700.

FIG. 7 illustrates one embodiment of a block diagram of a system 700. System 700 may comprise, for example, a communication system having multiple nodes. A node may comprise any physical or logical entity having a unique address in system 700. Examples of a node may include, but are not necessarily limited to, a computer, server, workstation, laptop, ultra-laptop, handheld computer, telephone, cellular telephone, personal digital assistant (PDA), router, switch, bridge, hub, gateway, wireless access point (WAP), and so forth. The unique address may comprise, for example, a network address such as an Internet Protocol (IP) address, a device address such as a Media Access Control (MAC) address, and so forth. The embodiments are not limited in this context.

The nodes of system 700 may be arranged to communicate different types of information, such as media information and control information. Media information may refer to any data representing content meant for a user, such as voice information, video information, audio information, text information, alphanumeric symbols, graphics, images, and so forth. Control information may refer to any data representing commands, instructions or control words meant for an automated system. For example, control information may be used to route media information through a system, or instruct a node to process the media information in a predetermined manner.

The nodes of system 700 may communicate media and control information in accordance with one or more protocols. A protocol may comprise a set of predefined rules or instructions to control how the nodes communicate information between each other. The protocol may be defined by one or more protocol standards as promulgated by a standards organization, such as the Internet Engineering Task Force (IETF), International Telecommunications Union (ITU), the Institute of Electrical and Electronics Engineers (IEEE), and so forth.

System 700 may be implemented as a wireless communication system and may include one or more wireless nodes arranged to communicate information over one or more types of wireless communication media. An example of a wireless communication media may include portions of a wireless spectrum, such as the radio-frequency (RF) spectrum. The wireless nodes may include components and interfaces suitable for communicating information signals over the designated wireless spectrum, such as one or more antennas, wireless transmitters/receivers ("transceivers"), amplifiers, filters, control logic, and so forth. Examples for the antenna may include an internal antenna, an omnidirectional antenna, a monopole antenna, a dipole antenna, an end fed antenna, a circularly polarized antenna, a microstrip antenna, a diversity antenna, a dual antenna, an antenna array, and so forth. In one embodiment, nodes of system 700 may include antenna systems 100, 400, 500, and 600 as previously discussed. The embodiments are not limited in this context.

Referring again to FIG. 7, system 700 may comprise node 702, 704, and 706 to form a wireless communication network, such as, a PAN, for example. Although FIG. 7 is shown with a limited number of nodes in a certain topology, it may be appreciated that system 700 may include more or less nodes in any type of topology as desired for a given implementation. The embodiments are not limited in this context. In one embodiment, system 700 may comprise node 702, 704, and 706 each may comprise a transceiver 708, 710, and 712, respectively, and a CMOS integrated circuit device 750. The CMOS integrated circuit device 750 may comprise any one of antenna systems 100, 400, 500, and 600 to form a wireless communication network through wireless links 752, 754, 756, for example.

Figure 8:
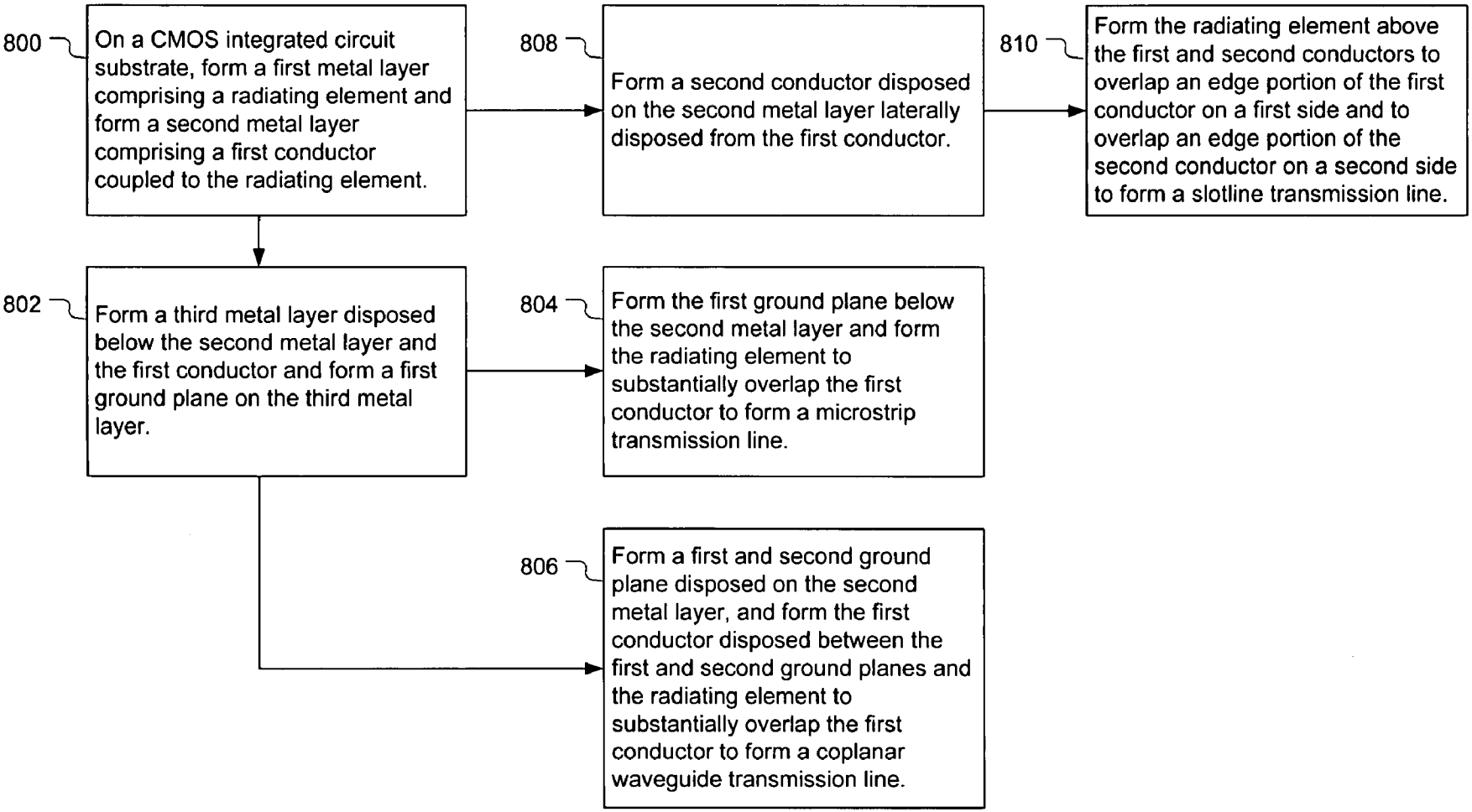
FIG. 8 illustrates one embodiment of a method of forming a CMOS semiconductor having antenna systems 100, 400, 500, and 600.

FIG. 8 illustrates one embodiment of a method of forming a CMOS semiconductor having antenna systems 100, 400, 500, and 600, for example. At block 800, on a CMOS integrated circuit substrate, form a first metal layer comprising a radiating element and form a second metal layer comprising a first conductor coupled to the radiating element. The first conductor and the radiating element are mutually coupled to form an antenna to wirelessly communicate a signal. At block 802, form a third metal layer disposed below the second metal layer and the first conductor and form a first ground plane on the third metal layer. At block 804, form the first ground plane below the second metal layer and form the radiating element to substantially overlap the first conductor to form a microstrip transmission line. At block 806, form a first and second ground plane disposed on the second metal layer, and form the first conductor disposed between the first and second ground planes and the radiating element to substantially overlap the first conductor to form a coplanar waveguide transmission line. In one embodiment, form a third metal layer and form the first and second ground planes on the third metal layer. At block 808, form a second conductor disposed on the second metal layer laterally disposed from the first conductor. At block 810, form the radiating element above the first and second conductors to overlap an edge portion of the first conductor on a first side and to overlap an edge portion of the second conductor on a second side to form a slotline transmission line.

Numerous specific details have been set forth herein to provide a thorough understanding of the embodiments. It will be understood by those skilled in the art, however, that the embodiments may be practiced without these specific details. In other instances, well-known operations, components and circuits have not been described in detail so as not to obscure the embodiments. It can be appreciated that the specific structural and functional details disclosed herein may be representative and do not necessarily limit the scope of the embodiments.

It is also worthy to note that any reference to "one embodiment" or "an embodiment" means that a particular feature, structure, or characteristic described in connection with the embodiment is included in at least one embodiment. The appearances of the phrase "in one embodiment" in various places in the specification are not necessarily all referring to the same embodiment.

Some embodiments may be described using the expression "coupled" and "connected" along with their derivatives. It should be understood that these terms are not intended as synonyms for each other. For example, some embodiments may be described using the term "connected" to indicate that two or more elements are in direct physical or electrical contact with each other. In another example, some embodiments may be described using the term "coupled" to indicate that two or more elements are in direct physical or electrical contact. The term "coupled," however, may also mean that two or more elements are not in direct contact with each other, but yet still co-operate or interact with each other. The embodiments are not limited in this context.

While certain features of the embodiments have been illustrated as described herein, many modifications, substitutions, changes and equivalents will now occur to those skilled in the art. It is therefore to be understood that the appended claims are intended to cover all such modifications and changes as fall within the true spirit of the embodiments.

The invention claimed is:

1. An apparatus, comprising:

a complementary metal oxide semiconductor (CMOS) integrated circuit device having a first metal layer comprising a radiating element; and a second metal layer comprising a first conductor coupled to said radiating element;

wherein said first conductor and said radiating element are mutually coupled to form an antenna to wirelessly communicate a signal; and wherein said radiating element is formed of raised metal on a top metal layer of said CMOS integrated circuit device.

2. The apparatus of claim 1, further comprising a second conductor disposed on said second metal layer laterally disposed from said first conductor, wherein said radiating element is disposed above said first and second conductors and overlaps an edge portion of said first conductor on a first side and overlaps an edge portion of said second conductor on a second side to form a slotline transmission line.

3. The apparatus of claim 1, wherein said radiating element forms a portion of an array for an antenna system.

4. The apparatus of claim 1, wherein said communication occurs at any one millimeter wavelength from 1 meter to 1 millimeter.

5. The apparatus of claim 1, wherein electrical energy in said first conductor is coupled to said radiating element via transverse electromagnetic modes created by electrically stimulating said first conductor.

6. The apparatus of claim 1, wherein said CMOS integrated circuit device comprises 130 nm CMOS devices.

7. The apparatus of claim 1, wherein said CMOS integrated circuit device comprises 90 nm CMOS devices.

8. The apparatus of claim 1, wherein said CMOS integrated circuit device comprises 65 nm CMOS devices.

9. The apparatus of claim 1, further comprising a third metal layer comprising a first ground plane disposed below said second metal layer and said first conductor.

10. The apparatus of claim 9, wherein said first ground plane is located below said second metal layer and said radiating element substantially overlaps said first conductor to form a microstrip transmission line.

11. The apparatus of claim 1, further comprising a first and second ground planes disposed on said second metal layer, wherein said first conductor is disposed between said first and second ground planes and said radiating element substantially overlaps said first conductor to form a coplanar waveguide transmission line.

12. The apparatus of claim 11, further comprising a third metal layer, wherein said first and second ground planes are disposed on said third metal layer.

13. The apparatus of claim 1, wherein said second metal layer is located one metal layer below said first metal layer.

14. The apparatus of claim 13, wherein said second metal layer is located about 10 μm below said first metal layer.

15. A system, comprising:

a transceiver; and a complementary metal oxide semiconductor (CMOS) integrated circuit device having a first metal layer comprising a radiating element; and a second metal layer comprising a first conductor coupled to said radiating element;

wherein said first conductor and said radiating element are mutually coupled to form an antenna to wirelessly communicate a signal; and wherein said radiating element is formed of raised metal on a top metal layer of said CMOS integrated circuit device.

16. The system of claim 15, further comprising a second conductor disposed on said second metal layer laterally disposed from said first conductor, wherein said radiating element is disposed above said first and second conductors and overlaps an edge portion of said first conductor on a first side and overlaps a an edge portion of said second conductor on a second side to form a slotline transmission line.

17. The system of claim 15, further comprising a third metal layer comprising a first ground plane disposed below said second metal layer and said first conductor.

18. The system of claim 17, wherein said first ground plane is located below said second metal layer and said radiating element substantially overlaps said first conductor to form a microstrip transmission line.

19. The system of claim 15, further comprising a first and second ground plane disposed on said second metal layer, wherein said first conductor is disposed between said first and second ground planes and said radiating element substantially overlaps said first conductor to form a coplanar waveguide transmission line.

20. The system of claim 19, further comprising a third metal layer, wherein said first and second ground planes are disposed on said third metal layer.

21. A method, comprising:

on a complementary metal oxide semiconductor (CMOS) integrated circuit substrate, forming a first metal layer comprising a radiating element; and forming a second metal layer comprising a first conductor coupled to said radiating element;

wherein said first conductor and said radiating element are mutually coupled to form an antenna to wirelessly communicate a signal; and wherein said radiating element is formed of raised metal on a top metal layer of said CMOS integrated circuit device.

22. The method of claim 21, further comprising forming a second conductor disposed on said second metal layer laterally disposed from said first conductor, wherein said radiating element is formed above said first and second conductor to overlap an edge portion of said first conductor on a first side and to overlap an edge portion of second conductor on a second side.

23. The method of claim 21, further comprising forming a third metal layer disposed below said second metal layer and said first conductor and forming a first ground plane on said third metal layer.

24. The method of claim 23, wherein forming said first ground plane comprises forming said first ground plane below said second metal layer and forming said radiating element comprises forming said radiating element to substantially overlap said first conductor to form a microstrip transmission line.

25. The method of claimed 21, further comprising forming a first and second ground plane disposed on said second metal layer,and forming said first conductor comprises forming said first conductor disposed between said first and second ground planes and radiating element to substantially overlap said first conductor to form a coplanar waveguide transmission line.

26. The method of claim 25, further comprising forming a third metal layer and forming said first and second ground planes on third metal layer.

* * * * *

UNITED STATES PATENT AND TRADEMARK OFFICE

CERTIFICATE OF CORRECTION

PATENT NO. : 7,256,740 B2
APPLICATION NO. : 11/095326
DATED : August 14, 2007
INVENTOR(S) : Tinsley et al.

It is certified that error appears in the above-identified patent and that said Letters Patent is hereby corrected as shown below:

In column 11, line 9, in Claim 16, after “overlaps” delete “a”.

In column 12, line 9, in Claim 22, delete “conductor” and insert -- conductors --, therefor.

In column 12, line 23, in Claim 25, delete “claimed” and insert -- claim --, therefor.

In column 12, line 25, in Claim 25, delete “layer,and” and insert -- layer, and --, therefor.

In column 12, line 27, in Claim 25, after “and” insert -- said --.

In column 12, line 33, in Claim 26, after “on” insert -- said --.

Signed and Sealed this

Thirteenth Day of November, 2007

JON W. DUDAS
*Director of the United States Patent and Trademark Office*